United States Patent [19]

Milligan

[11] 4,226,224

[45] Oct. 7, 1980

[54] WOOD BURNING STOVE FOR HEATING HOMES

[76] Inventor: Orley B. Milligan, P.O. Box 279, Medford, Oreg. 97501

[21] Appl. No.: 916,498

[22] Filed: Jun. 19, 1978

[51] Int. Cl.[3] ..... F24C 15/25

[52] U.S. Cl. ..... 126/83

[58] Field of Search ..... 126/63, 64, 66, 67, 126/68, 77, 112, 83

[56] References Cited

U.S. PATENT DOCUMENTS

| | | | |
|---|---|---|---|
| 849,872 | 4/1907 | Weldon | 126/69 |
| 2,058,094 | 10/1936 | Merrill | 126/70 |
| 2,513,443 | 7/1950 | Barlow | 126/77 |
| 3,986,488 | 10/1976 | Hannebaum | 126/120 |

*Primary Examiner*—Samuel Scott
*Assistant Examiner*—Wesley S. Ratliff, Jr.
*Attorney, Agent, or Firm*—Clarence A. O'Brien; Harvey B. Jacobson

[57] ABSTRACT

A horizontally elongated hollow body constructed of heat resistant material is provided and closed at its opposite ends by means of upstanding end wall structures. The body includes a flue gas outlet centrally intermediate the opposite ends thereof and one end wall structure includes an access opening with which a closure door, shiftably supported from the corresponding end of the body, is operatively associated for movement between an open and closed positions relative to the access opening. The door and the opposite end wall structure of the body each include combustion air inlet structure for admitting combustion air into the interior of the body and structure is provided for variably throttling the inflow of combustion air. The flue outlet opens outwardly of an upper portion of one longitudinal side of the body and the other longitudinal side of the body defines a viewing aperture therein closed by a transparent heat resistant panel. The hollow body is supported atop a pedestal and the combustion air inlet means at opposite ends of the body are disposed at different elevations. Further, the cross-sectional area of the flue gas outlet is considerably greater than the cross-sectional area of the combined combustion air inlet structure, whereby combustion air is jetted into the opposite ends of the body at different elevations for enhancing more complete combustion of combustible materials and gases within the hollow body.

27 Claims, 14 Drawing Figures

WOOD BURNING STOVE FOR HEATING HOMES

BACKGROUND OF THE INVENTION

Various forms of wood and other solid fuel burning stoves have been heretofore provided for heating the interiors of residences and other buildings. However, these previously known forms of stoves have, for various reasons, not been as efficient as possible in producing a maximum amount of heat from a given amount of fuel. Accordingly, a need exists for a stove designed specifically for heating purposes and which will be efficient in producing a maximum amount of heat for a given amount of fuel burned therein.

Further, various forms of residence heating stoves, while being heretofore approved for operation in permanent structures, have not been capable of receiving controlling authority approval for use in mobile homes. Accordingly, a further need exists for an efficient stove for use in heating the interior of mobile homes, and the like.

BRIEF DESCRIPTION OF THE INVENTION

The stove of the instant invention includes a horizontally elongated hollow body for receiving solid fuel to be burned therein. The opposite ends of the hollow body are closed by means of upstanding opposite end wall structures and the hollow body is provided with a flue gas outlet therefor centrally intermediate the opposite ends thereof. The opposite end wall structures of the hollow body include air inlet openings disposed at different elevations and the effective cross-sectional area of the flue gas outlet is appreciably greater than the total effective cross-sectional area of the combustion air inlet opening formed in the opposite end wall structures of the hollow body. In this manner, combustion air is, by pressure differential between the interior of the hollow body and the exterior thereof, jetted into opposite ends of the hollow body at different elevations in order to effect a swirling of combustion air within the hollow body about and above the fuel being burned therein and thereby enhance more complete combustion of the solid fuel and unburned flammable gasses in the upper portion of the hollow body driven off from the solid fuel being burned in the hollow body. Further, structure is provided for variably throttling the intake of combustion air into the interior of the hollow body and the hollow body is provided with a baffle overlying but spaced from the flue gas outlet and operatively associated with the latter, whereby flue gasses to be discharged from the flue gas outlet must initially pass from beneath the baffle to above the latter in the opposite end portions of the interior of the horizontally elongated body of the stove.

The main object of this invention is to provide a stove which will be capable of burning wood and other solid fuels more efficiently for the purpose of heating the interiors of residences, including mobile homes.

Another object of this invention is to provide a stove construction specifically adapted for use in mobile homes and for approval by various governing authorities who may render approval of fuel burning stoves for use in mobile homes.

Still another object of this invention is to provide a solid fuel burning stove including novel air inlet means for facilitating more complete combustion of the solid fuel and unburned gasses driven from the solid fuel within the body of the stove.

Yet another important object of this invention is to provide a stove in accordance with the preceding objects and constructed in a manner whereby outside air may be readily utilized as combustion air for the stove.

A further object of this invention is to provide a stove in accordance with the preceding objects including a viewing window therein closed by means of a heat resistant, transparent panel.

A further important object of this invention is to provide a stove including spark arresting means operatively associated with the combustion air inlet structure for the stove.

A final object of this invention to be specifically enumerated herein is to provide a solid fuel burning stove in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
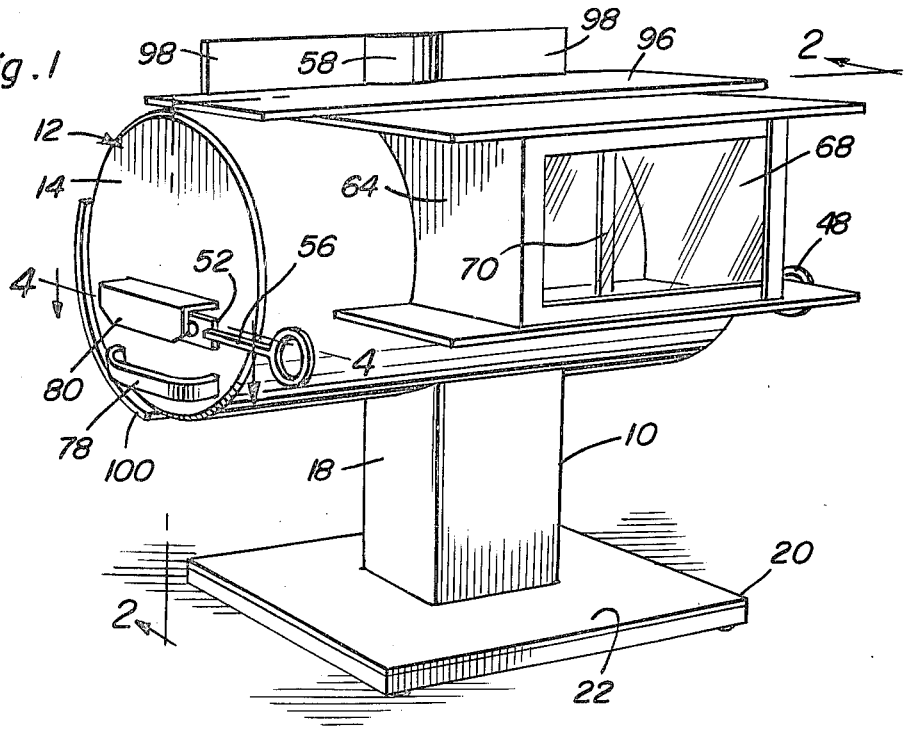
FIG. 1 is a perspective view of a first form of stove constructed in accordance with the present invention.

Referring now more specifically to the drawings, the numeral 10 generally designates a first form of stove including a horizontally elongated generally cylindrical body referred to in general by the reference numeral 12. The body 12 includes upstanding opposite end wall structures 14 and 16 closing the opposite ends thereof and is supported atop a center tubular pedestal 18 including a horizontally enlarged hollow downwardly opening base 20 at its lower end. The top wall 22 of the base 20 includes an opening 24 therein opening into the lower end of the pedestal 18 and the upper end of the pedestal includes an opening 26 in the rear wall 28 thereof. Further, the base 20 includes vertically short depending feet 30 for engaging and supporting the base 20 in slightly spaced relation above a suitable horizontal support surface 32.

The end wall structure 16 includes a cruciform access opening 34 formed therein and swingably supports a closure door 36 from the exterior thereof by means of a hinge assembly 38. The closure door 36 is provided with a plurality of horizontally spaced apart combustion air inlet openings 40 and a horizontally elongated damper plate 42 provided with longitudinally spaced openings 44 is slidably supported for rectilinear movement from the exterior of the door 36 and has an operating rod 46 supported therefrom and having a finger-engageable ring 48 on its free end. The damper plate 42 is shiftable between positions with the openings 44 in and out of registry with the openings 40 upon shifting of the rod 46 by means of the finger-engageable ring 48. Therefore, combustion air flowing into the into the interior of the body 12 through the openings 40 may be regulated by the damper plate 42.

Figure 3:
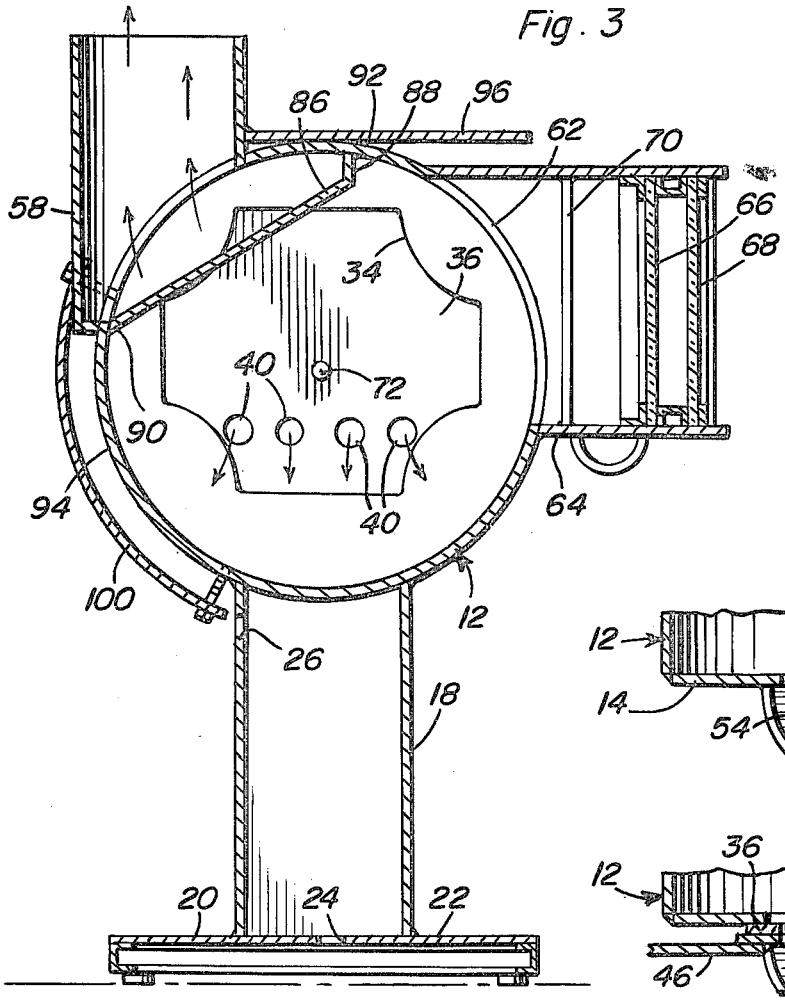
FIG. 3 is a vertical sectional view taken substantially upon the plane indicated by the section line 3—3 of FIG. 2.
Figure 4:
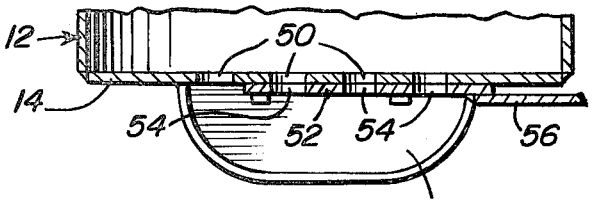
FIG. 4 is a fragmentary, enlarged, horizontal sectional view taken substantially upon the plane indicated by the section line 4—4 of FIG. 1 and with the corresponding combustion air damper control in the full open position.
Figure 5:
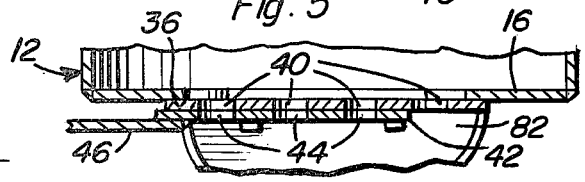
FIG. 5 is a fragmentary, horizontal sectional view similar to FIG. 4 but illustrating the opposite end of the stove and the corresponding combustion air damper control in the full open position.
Figure 2:
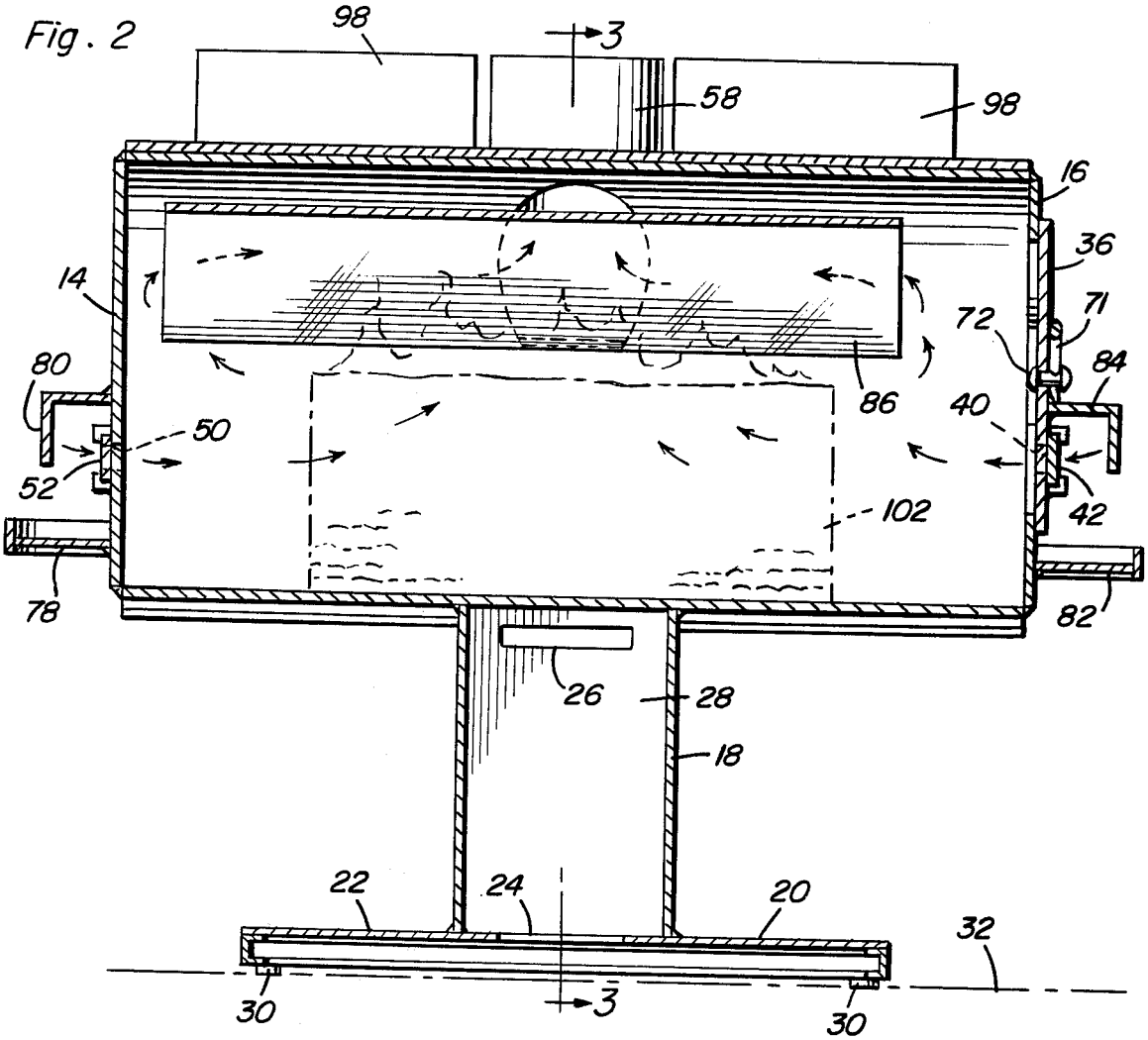
FIG. 2 is an enlarged, fragmentary, vertical sectional view taken substantially upon the plane indicated by the section line 2—2 of FIG. 1.
Figure 6:
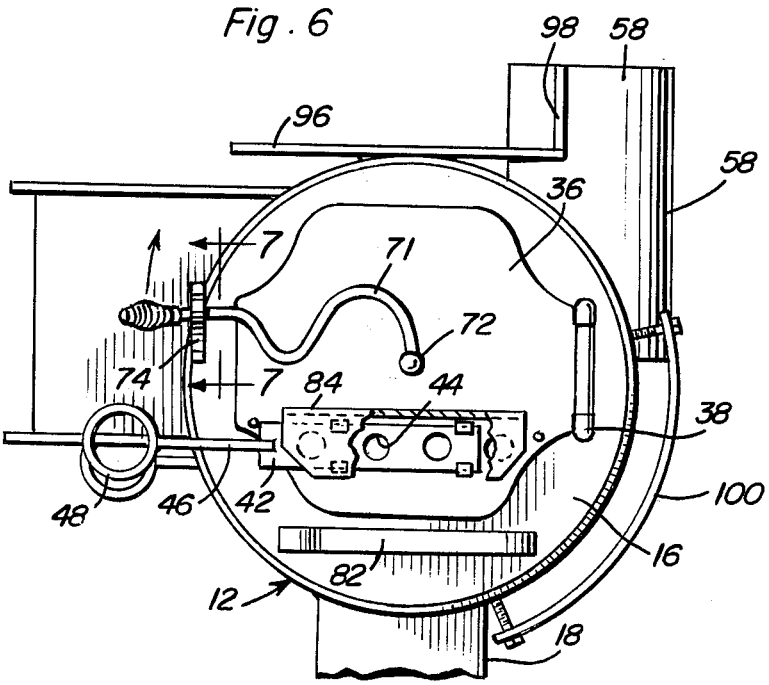
FIG. 6 is a fragmentary, side elevational view of the stove illustrated in FIG. 1 as seen from the right side thereof.
Figure 7:
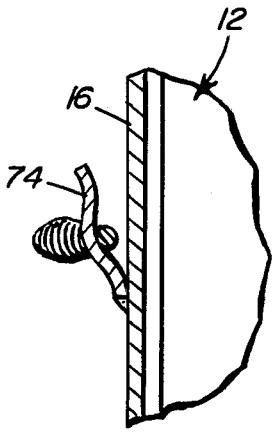
FIG. 7 is a fragmentary, enlarged, vertical sectional view taken substantially upon the plane indicated by the section line 7—7 of FIG. 6.
Figure 8:
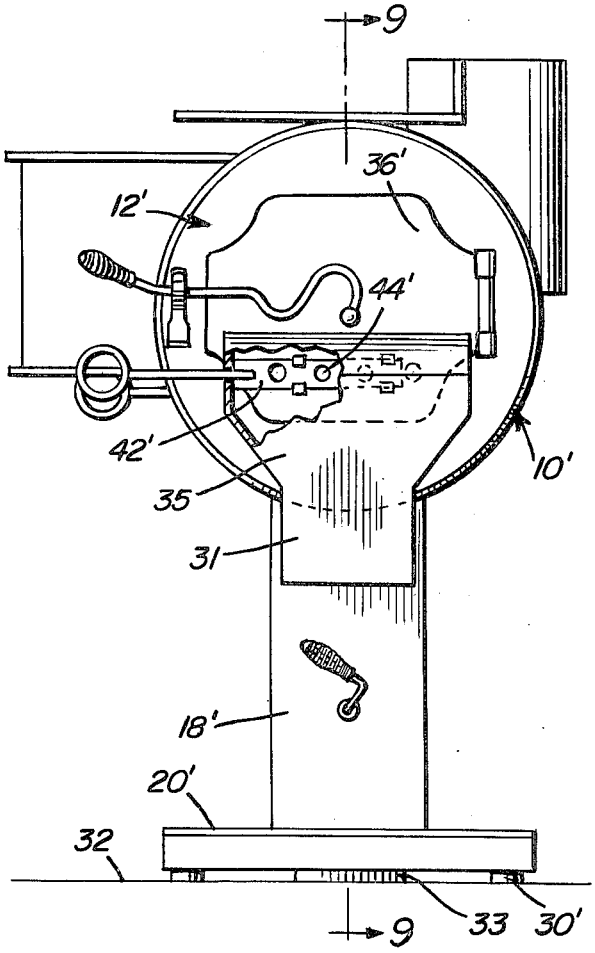
FIG. 8 is an end elevational view of a modified form of stove as seen from the right side thereof.
Figure 12:
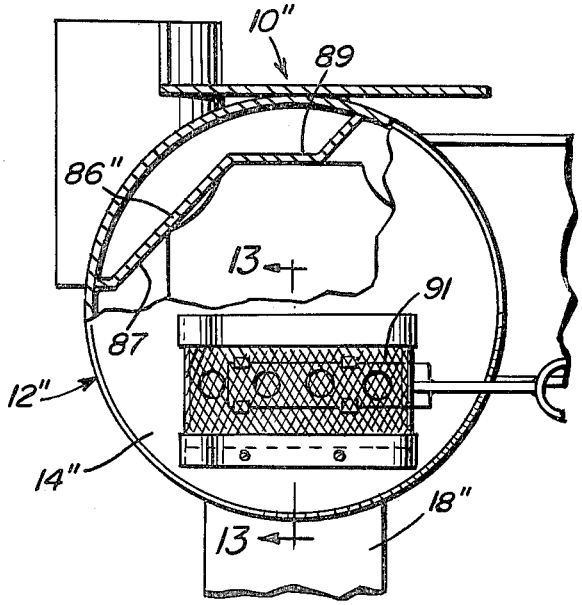
FIG. 12 is a fragmentary, left end elevational view of a third form of stove with portions of the adjacent end wall being broken away.
Figure 11:
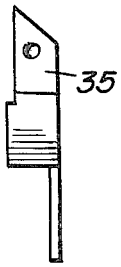
FIG. 11 is a side elevational view of the portion of the right hand side combustion air manifold supported from the door hingedly supported from the right hand end of the stove illustrated in FIG. 9.
Figure 13:
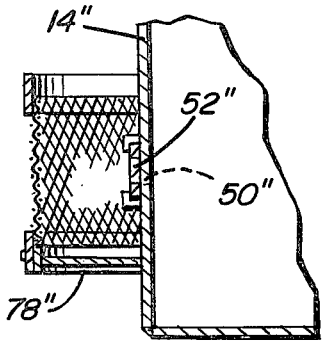
FIG. 13 is a fragmentary, enlarged, vertical sectional view taken substantially upon the plane indicated by the section line 13—13 of FIG. 12.

The left hand end wall structure 14 of the body illustrated in FIG. 4 includes horizontally spaced apart combustion air inlet openings 50 corresponding to the air inlet openings 40 and a damper plate 52 corresponding to the damper plate 42 and including openings 54 therein is slidably supported from the end wall structure 14 and includes an operating rod 56 anchored relatively thereto corresponding to the operating rod 46. Accordingly, combustion air may be admitted into the interior of the body 12 through the opposite ends thereof. From FIG. 2 of the drawings it may be seen that the combustion air inlet openings 50 are disposed at an elevation below the elevation of the combustion air inlet openings 40. Further, it may be seen from FIGS. 2, 3 and 6 of the drawings that the body 12 includes a vertical flue pipe 58 opening outwardly of the upper portion of the rear of the body 12 above the horizontal center line thereof. The flue pipe 58 is of a cross-sectional area considerably greater than the total cross-sectional area of the combustion air inlet openings 40 and 50. Accordingly, when the combustion air enters the body 12 through the openings 40 and 50, it jets into the interior of the body 12 at different levels and thereby effects a swirling motion to combustion air within the body 12 enhancing more complete combustion of solid fuel within the body and also more complete combustion of otherwise non-burned combustible gasses driven from the combustible fuel.

The front side of the body 12 has a viewing port 62 formed therein and a horizontally outwardly projecting viewing port or window framing structure 64 is supported from the body 12 and has a pair of horizontally spaced heat resistant transparent panels 66 and 68 mounted in spaced relation across the outer forward end thereof and the framing structure 64 includes vertically extending horizontally spaced bars 70 at the inner end thereof spaced slightly outwardly of the viewing port 62 as a guard against solid fuel material within the body 12 being accidentally displaced outwardly through the framing structure 64 into contact with the inner transparent panel 66.

The door 36 has a handle 71 pivotally supported therefrom as at 72 and the free end of the handle 71 is operatively associated with a stationary latch 74 carried by the left hand end wall structure 16 of the body 12. Therefore, the handle or lever 70 may be utilized to removably latch the hinged closure door 36 in the closed position closing the opening 34.

The end wall 14 includes a horizontally outwardly projecting lip 78 disposed beneath the openings 50 and the damper plate 52 and an inverted L-shape spark arrestor 80 is secured to the outer side of the end wall structure 14 and extends downwardly into horizontal registry with the openings 50 and 52 outwardly of the latter and above the lip 78. A similar lip 82 is supported from the end wall structure 16 below the closure door 36 and an inverted L-shaped spark arrestor 84 corresponding to the spark arrestor 80 is supported from the other side of the closure door 36.

The interior of the body 12 includes an inclined baffle plate 86 including upper and lower longitudinal marginal edge portions 88 and 90 and the upper and lower marginal edge portions of the baffle plate 86 are secured and sealed relative to the top and rear walls 92 and 94 of the body 12 above and below, respectively, the point at which the flue pipe 58 opens into the interior of the body 12 through the upper portion of the rear wall thereof. The opposite ends of the baffle plate 86 are spaced from the corresponding end wall structures 14 and 16 of the body 12 in the manner illustrated in FIG. 2 of the drawings. Also, the top wall 92 of the body 12 includes a horizontal support plate 96 supported therefrom and anchored relative to the flue pipe 58 and upstanding flanges 98 carried by the top wall 92 on opposite sides of the flue pipe 58. The plate 96 may be utilized as a cooking surface, if desired.

The openings 24 and 26 are provided whereby the pedestal and base may be cooled by convection air currents and the lower rear quadrant of the body 12 has an arcuate heat shield 100 supported therefrom in spaced relation relative thereto.

The different elevations of the combustion air inlet openings 40 and 50 is extremely important in order that combustion air may be jetted into opposite ends of the body 12 at different elevations and thereby caused to swirl within the body 12 in order to enhance more complete combustion of the solid fuel 102 being burned within the body 12 as well as the unburned combustible gasses driven from the solid fuel 102 and which have been elevated within the body 12 to the upper portion thereof. The baffle plate 86 insures that the unburned combustible gasses driven from the solid fuel 102 will not move directly upwardly within the body 12 and outwardly of the flue gas pipe 58. Rather, the swirling combustion air admitted into the opposite ends of the body 12 will commingle with the unburned flammable gasses driven from the solid fuel 102 supporting complete combustion thereof below the baffle plate 86 before the flue gasses from combustion within the body 12 pass around the opposite ends of the baffle plate 86 to the area above the latter and thereafter pass outwardly of the body 12 through the flue pipe 58.

Referring now more specifically to FIGS. 8 through 11 of the drawings, there may be seen a modified form of stove referred to in general by the reference numeral 10'. The stove 10' includes numerous components thereto similar to the various components of the above described stove 10 and which are, therefore, designated by corresponding prime reference numerals. The stove 10' differs from the stove 10 in that the opening 24' in the top wall 22' of the base 20' thereof is larger than the opening 24 and the upstanding tubular pedestal 18' includes a damper 19 supported therein for adjustable oscillation about a horizontal transverse axis. In addition, rather then the pedestal 18' including an opening corresponding to the opening 26, the pedestal 18' includes upper end openings 26' opening outwardly therefrom toward opposite ends of the body 12' and with which inlet adjacent ends of elongated combustion air manifolds 27 supported from underlying and extending along the bottom wall 29 of the body 12' are communicated. The remote ends of the manifold 27 are directed upwardly as at 31 on the right hand side of FIG. 9 and 33 on the left hand side of FIG. 9. The upwardly directed portion 31 is abbreviated in elevation and is completed by a manifold section 35 thereof supported from the closure door 36' and overlying the combustion air inlet openings 40', the damper plate 42' and the openings corresponding to the openings 44 formed in the damper plate 42'. The manifold section 35 includes edge portions thereof tightly abutted against the outer surface of the end wall structure 16' when the closure door 36' is in the closed position thereof and also edge portions thereof closely opposing the upper edge portions of the upwardly directed portion 31 of the right hand manifold 27 illustrated in FIG. 9. Therefore, the right hand manifold 27 and the manifold section 35 serve to convey combustion air entering the lower end of the pedestal 18' through the opening 24' into the right hand end of the body 12' of the stove 10'.

Figure 9:
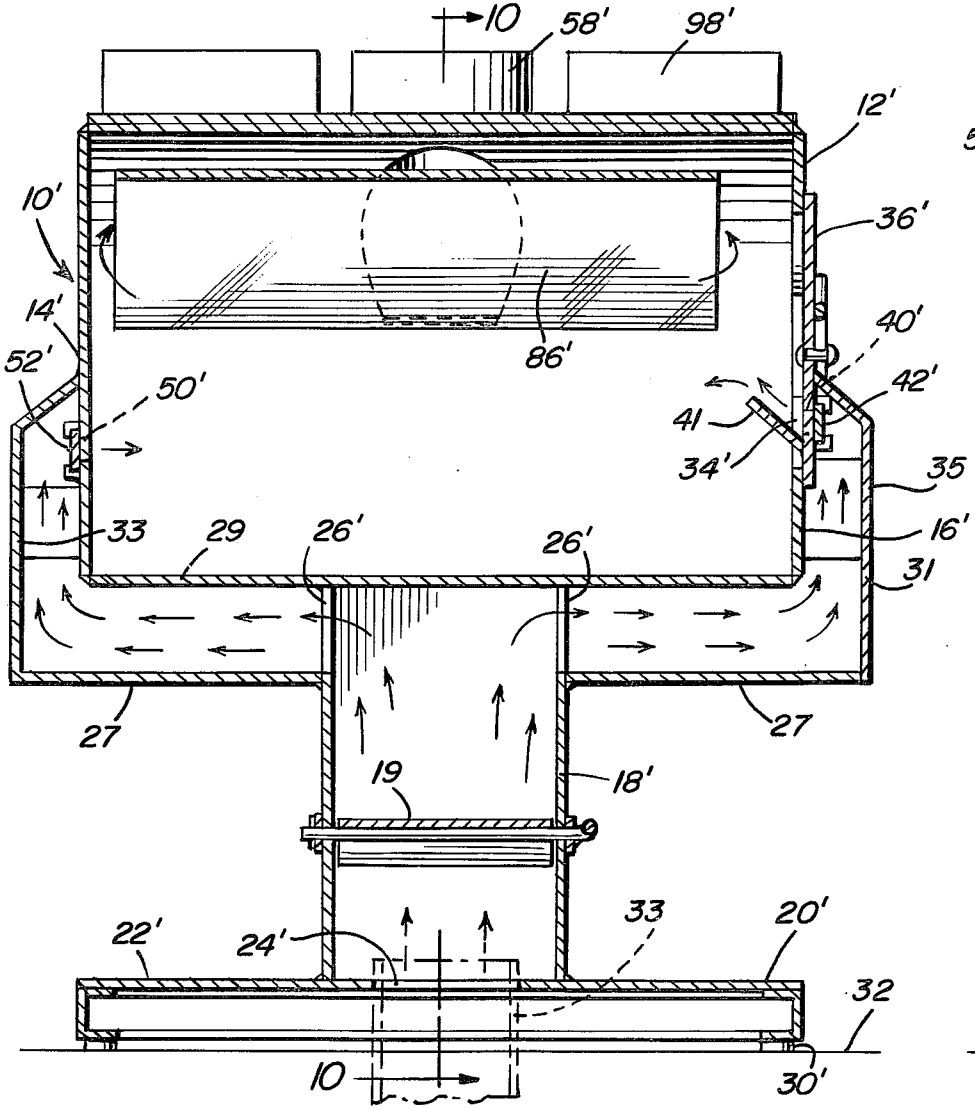
FIG. 9 is an enlarged, fragmentary, longitudinal vertical sectional view taken substantially upon the plane indicated by the section line 9—9 of FIG. 8.

On the other hand, the upwardly directed portion or section 33 of the left hand manifold 27 in FIG. 9 overlies the lower portion of the end wall structure 14' and the combustion air inlet openings 50' formed therein as well as the damper plate 52' slidably supported from the exterior of the end wall structure 14'. Although the damper 19 is provided for controlling the flow of combustion air upwardly through the pedestal 18', air entering the combustion air inlet openings 40' and 50' may also be variably controlled by means of the damper plates 42' and 52'. Further, the inner side of the closure door 36' include an inwardly and upwardly inclined combustion air deflector plate 41 for upwardly deflecting combustion air jetting into the opposite ends of the body 12'. Of course, the body 12' includes a baffle plate 86' corresponding to the baffle plate 86. Also, the surface 32' upon which the base 22' rests comprises the floor of a mobile home upwardly through which a fresh air duct 33 opens, the open end of the combustion air duct discharging into the lower end of the pedestal 18' through the opening 24'.

Referring now more specifically to the drawings, the numeral 10'' generally designates a third form of stove constructed in accordance with the present invention. The stove 10'' is substantially identical to the stove 10, except that the baffle plate 86'' thereof includes a lower inclined portion 87 terminating upwardly in a horizontally directed portion 89. In addition, the stove 10'', rather than including the inverted L-shaped spark arrestors 80 and 84, includes screen-type spark arrestors 91 supported from the lip 78'' and the opposite end lip (not shown) corresponding to the lip 82. Otherwise, the stoves 10 and 10'' are structural and operationally similar.

Figure 14:
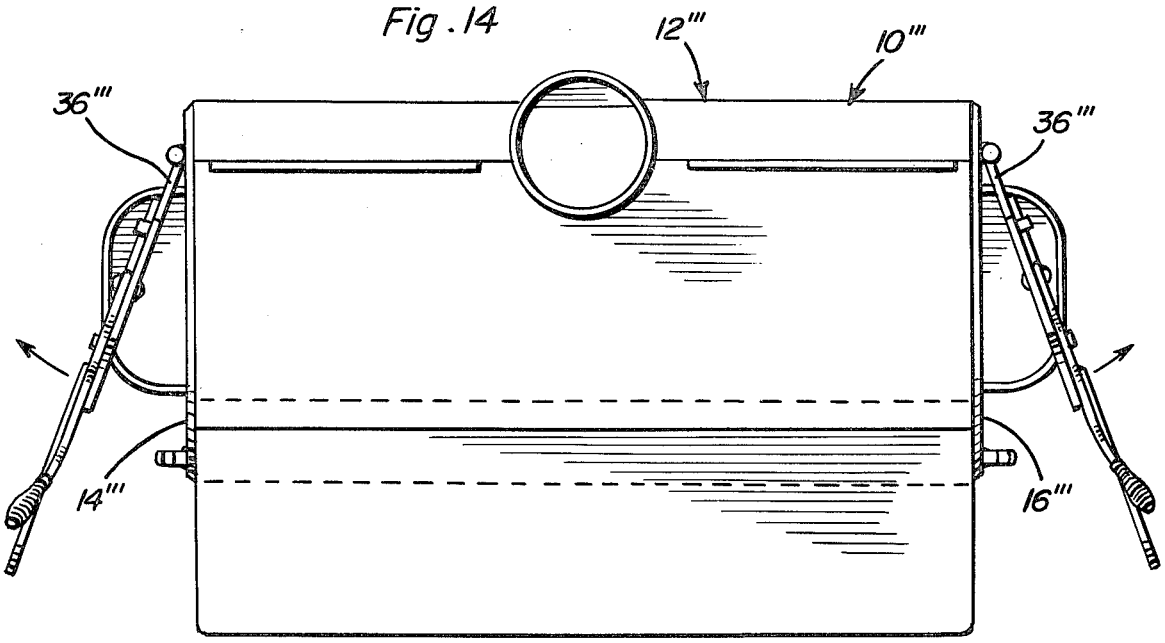
FIG. 14 is a top plan view of a fourth form of stove constructed in accordance with the present invention.
Figure 10:
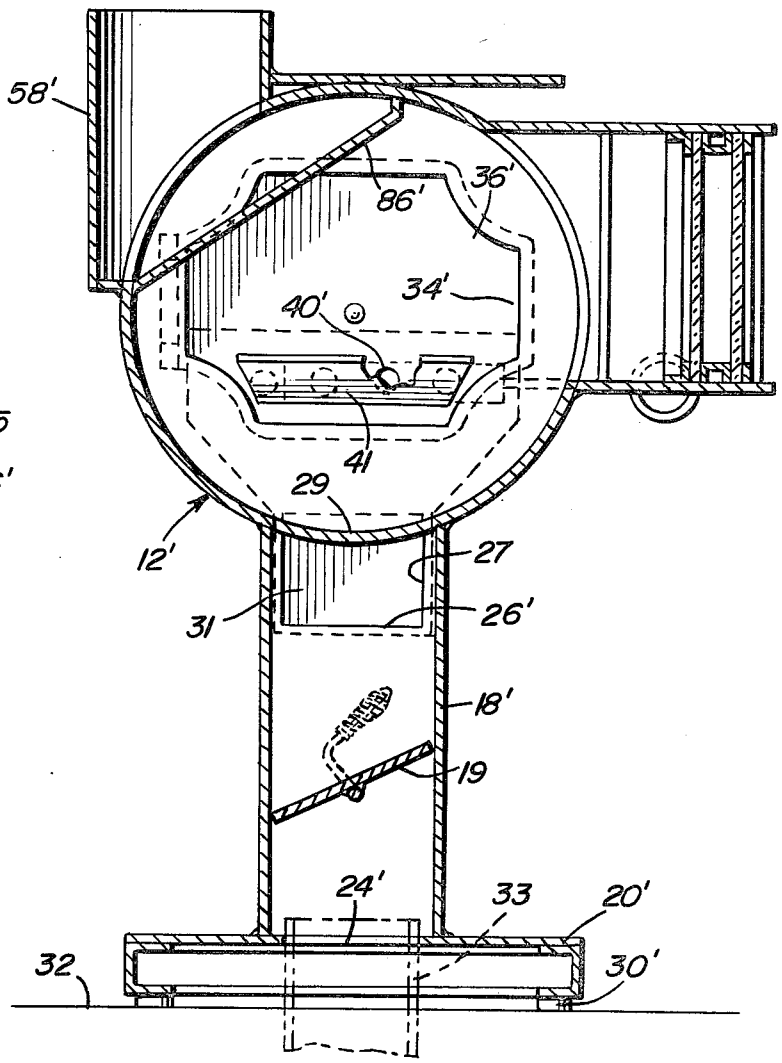
FIG. 10 is a transverse, vertical sectional view taken substantially upon a plane indicated by the section line 10—10 of FIG. 9.

With reference now more specifically to FIG. 14 of the drawings, there may be seen a fourth form of stove referred to in general by the reference numeral 10'''. The stove 10''' is substantially identical to the stove 10' except that the end wall structures 14''' and 16''' thereof each include openings corresponding to the opening 34 and having hinged closure doors 36''' operatively associated therewith.

If it is desired, the stove 10 could be provided with a flue pipe corresponding to the pipe 58 opening outwardly through a central portion of the top wall 92 thereof and both the front and rear sides of the body 12 could be provided with viewing ports 62 and frame structures 64 each including panels 66 and 68. In such instance, the baffle plate corresponding to the baffle plate 86 would be supported in spaced relation below the lower end of such a relocated flue pipe 58.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A stove for burning wood and other solid fuels, said stove including a horizontally elongated hollow body having opposite sides and opposite ends, defining a combustion chamber therein and including a flue gas outlet centrally intermediate the opposite ends of said body opening outwardly of an upper portion of said combustion chamber, the opposite ends of said body being provided with upstanding end wall structures each including combustion air inlet means for admitting combustion air therethrough in a generally horizontal direction into the interior of said body from the exterior thereof, support means operatively connected to said hollow body for support of said body from a suitable support structure, said body including means for admitting solid fuel to be burned thereinto, and a generally horizontal baffle plate in said combustion chamber above the level of said air inlet means, registered with and spaced below said flue gas outlet, said plate extending longitudinally of said body and including opposite side marginal portions sealed relative to said hollow body sides and opposite end marginal portions spaced inwardly of said end wall structures, a lower portion of the interior of said hollow body intermediate the opposite ends thereof and spaced below said baffle plate being adapted to receive said solid fuel for burning in said combuston chamber below said baffle plate.

2. The combination of claim 1 wherein said body includes opposite side walls, said flue gas outlet opening outwardly through one side wall of said body, the other side wall of said body defining a viewing aperture therein closed by a transparent heat resistant panel.

3. The combination of claim 1 including adjustable air flow controlling means operatively associated with said combustion air inlet means for controlling the air flow therethrough.

4. The combination of claim 3 wherein said adjustable air flow controlling means includes means for simultaneously and equally controlling the air flow through said combustion air inlet means.

5. The combination of claim 3 wherein said adjustable air flow controlling means includes means for independently variably controlling the air flow through said combustion air inlet means.

6. The combination of claim 1 wherein one of said end wall structures includes an access opening formed therein comprising said means for admitting fuel, and a closure door supported from said one end wall structure for shifting between first and second positions opening and closing, respectively, said access opening.

7. The combination of claim 6 wherein said combustion air inlet means for said one end wall structure includes at least one air inlet opening formed through said closure door.

8. The combination of claim 7 including adjustable air flow controlling means operatively associated with said combustion air inlet means for controlling the air flow therethrough.

9. The combination of claim 8 wherein said adjustable air flow controlling means includes means for simultaneously and equally controlling the air flow through said combustion air inlet means.

10. The combination of claim 1 wherein each of said end wall structures includes an access opening formed therein, a closure door supported from each of said end wall structures for shifting between first and second positions opening and closing, respectively, the corresponding access opening.

11. The combination of claim 1 wherein said baffle plate is inclined and includes upper and lower longitudinal marginal edge portions comprising said opposite side marginal portions.

12. The combination of claim 11 wherein said baffle plate includes an inclined lower portion terminating upwardly in a generally horizontally disposed upper portion.

13. The combination of claim 11 wherein said baffle plate is inclined throughout substantially its entire width extending between the upper and lower longitudinal marginal edge portions thereof.

14. The combination of claim 1 wherein said support means includes an upright hollow pedestal from whose upper end said body is supported, and a horizontal supportive base from which the lower end of said pedestal is supported.

15. The combination of claim 14 wherein said base includes upstanding fresh air passage means extending therethrough adapted at its lower end to receive outside fresh air and opening into said pedestal at its upper end, hollow horizontal manifolds underlying and extending along underside portions of the opposite end portions of said body on opposite sides of the upper end of said pedestal, one adjacent pair of ends of said manifolds opening into said pedestabl through said opposite sides, the other pair of remote ends of said manifolds including upwardly directed terminal ends overlying the outer sides of the corresponding end wall structures and opening toward and enjoying at least a reasonably good air seal with portions of said end wall structures disposed about the corresponding air inlet means.

16. The combination of claim 15 including adjustable damper means in said pedestal for controlling the upward flow of combustion air therethrough.

17. The combination of claim 15 wherein one of said end wall structures includes an access opening formed therein, and a closure door supported from said one end wall structure for shifting between first and second positions opening and closing, respectively, said access opening, said combustion air inlet means for said one end wall structure includes at least one air inlet opening forming through said closure door, the upper portion of the upwardly directed manifold terminal end being horizontally displaceable from the remainder thereof and supported from the exterior of said closure door, said closure door being horizontally swingably supported from said one end wall structure.

18. The combination of claim 14 wherein said base includes upstanding cooling air passage means opening downwardly from the underside of said base and upwardly into the lower end of said pedestal, the upper end of said pedestal including a lateral cooling air outlet opening horizontally outwardly therefrom.

19. The combination of claim 18 wherein said body includes front and rear longitudinal sides, said lateral cooling air outlet opening outwardly of the side of said pedestal corresponding to the rear side of said body.

20. The combination of claim 19 including a heat shield panel supported in spaced relation relative to and outwardly of said rear side of said body defining an upstanding convection air passage between said heat shield panel and said rear side of said body and open at its upper and lower ends, said lateral cooling air outlet being positioned to discharge cooling air therefrom for upward movement through said convection air passage.

21. The combination of claim 1 wherein said combustion air inlet means include means for admitting combustion air generally horizontally into the opposite ends of said body at different elevations.

22. The combination of claim 21 wherein the effective cross-sectional area of said flue gas outlet is appreciably greater than the effective total cross-sectional area of said combustion air inlet means, whereby combustion air entering said body through said air inlet means is jetted into opposite ends of said body at different elevations therein.

23. The combination of claim 22 including an upwardly and inwardly inclined deflector plate supported from the inner side of one of said end wall structures and operative to upwardly deflect combustion air being jetted into said body.

24. The combination of claim 1 wherein said end wall structures include ash and spark catching horizontally outwardly projection lips supported from said end wall structures below said air inlet means.

25. The combination of claim 24 including upstanding spark deflector means supported from said body horizontally outwardly of said combustion air inlet means and above said lips.

26. The combination of claim 25 wherein said upstanding spark deflector comprises an imperforate metal panel portion.

27. The combination of claim 25 wherein said upstanding spark deflector includes a foraminated panel portion.

* * * * *